US007941253B1

(12) United States Patent
Brant

(10) Patent No.: US 7,941,253 B1
(45) Date of Patent: May 10, 2011

(54) MARINE PROPULSION DRIVE-BY-WIRE CONTROL SYSTEM WITH SHARED ISOLATED BUS

(75) Inventor: Jeffery A. Brant, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 793 days.

(21) Appl. No.: 11/945,350

(22) Filed: Nov. 27, 2007

(51) Int. Cl.
*B60L 3/00* (2006.01)

(52) U.S. Cl. ..... 701/21

(58) Field of Classification Search ..... 701/1, 21, 701/33, 36, 48
See application file for complete search history.

(56) References Cited

U.S. PATENT DOCUMENTS 6,273,771 B1 8/2001 Buckley et al.
6,382,122 B1 5/2002 Gaynor et al.
6,704,643 B1 3/2004 Suhre et al.
6,881,106 B1 4/2005 Gonring
7,104,851 B1 9/2006 Gonring et al.
7,131,385 B1 11/2006 Ehlers et al.
7,218,118 B1 5/2007 Gonring
7,267,068 B2 9/2007 Bradley et al.
7,483,778 B2 * 1/2009 Armbruster et al. ..... 701/48

* cited by examiner

*Primary Examiner* — Kim T Nguyen
(74) *Attorney, Agent, or Firm* — Andrus, Sceales, Starke & Sawall, LLP

(57) ABSTRACT

A marine propulsion drive-by-wire control system controls multiple marine engines, each one or more PCMs, propulsion control modules for controlling engine functions which may include steering or vessel vectoring. A helm has multiple ECUs, electronic control units, for controlling the multiple marine engines. A CAN, controller area network, bus connects the ECUs and PCMs with multiple PCM and ECU buses. The ECU buses are connected through respective isolation circuits isolating the respective ECU bus from spurious signals in another ECU bus.

21 Claims, 4 Drawing Sheets

MARINE PROPULSION DRIVE-BY-WIRE CONTROL SYSTEM WITH SHARED ISOLATED BUS

BACKGROUND AND SUMMARY

The invention relates to marine propulsion drive-by-wire control systems.

Marine propulsion drive-by-wire control systems are known in the prior art for controlling multiple marine engines each having a PCM, propulsion control module. A vessel helm has multiple ECUs, electronic control units, for controlling the multiple marine engines, and a CAN, controller area network, bus connecting the ECUs and PCMs. The systems are typically redundant, and include a second helm having multiple redundant ECUs for controlling the multiple marine engines.

The present invention arose during continuing development efforts directed toward the above systems, and continuing improvements in reliability and integrity.

DETAILED DESCRIPTION

Prior Art

Figure 1:
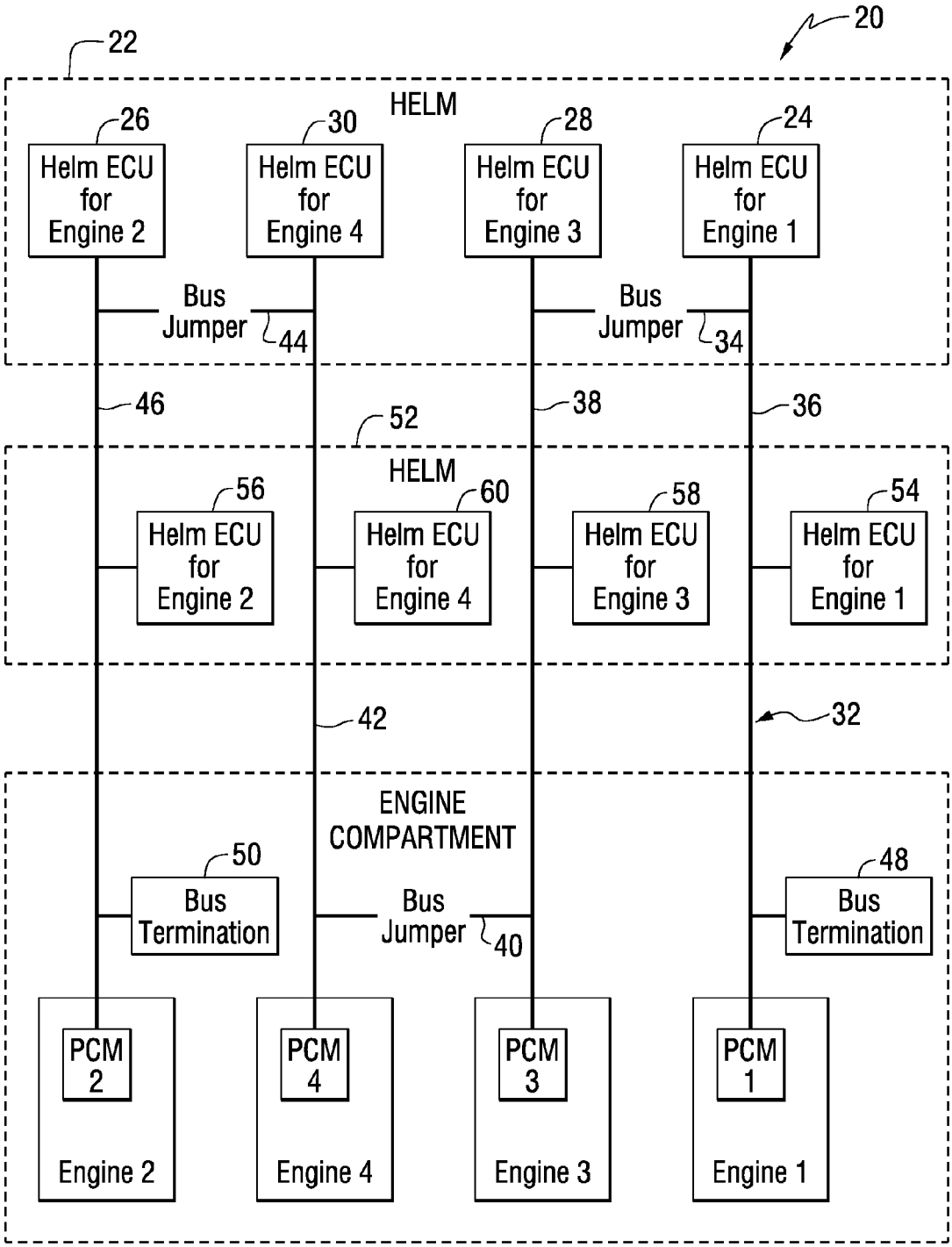
FIG. 1 PRIOR ART
FIG. 1 shows a marine propulsion drive-by-wire control system known in the prior art.

FIG. 1 shows a marine propulsion drive-by-wire control system 20 for multiple marine engines, such as engines 1, 2, 3, 4, each having a PCM, propulsion control module, such as PCM 1, PCM 2, PCM 3, PCM 4, as known in the prior art. Vessel helm 22 has multiple ECUs, electronic control units, for controlling the multiple marine engines, for example ECU 24 for controlling engine 1, ECU 26 for controlling engine 2, ECU 28 for controlling engine 3, ECU 30 for controlling engine 4. A CAN, controller area network, bus 32 connects the ECUs and PCMs, and includes bus jumpers connecting various portions of the bus so that the various components may communicate with each other via a shared bus, for example jumper 34 connecting buses 36 and 38, jumper 40 connecting buses 38 and 42, jumper 44 connecting buses 42 and 46. The CAN bus is terminated at its farthest ends, e.g. bus terminations 48 and 50. For redundancy, a second helm 52 also has multiple ECUs 54, 56, 58, 60 for controlling the multiple marine engines, namely engine 1, engine 2, engine 3, engine 4, respectively. ECUs 54, 56, 58, 60 are connected to a respective bus 36, 46, 38, 42.

Figure 2:
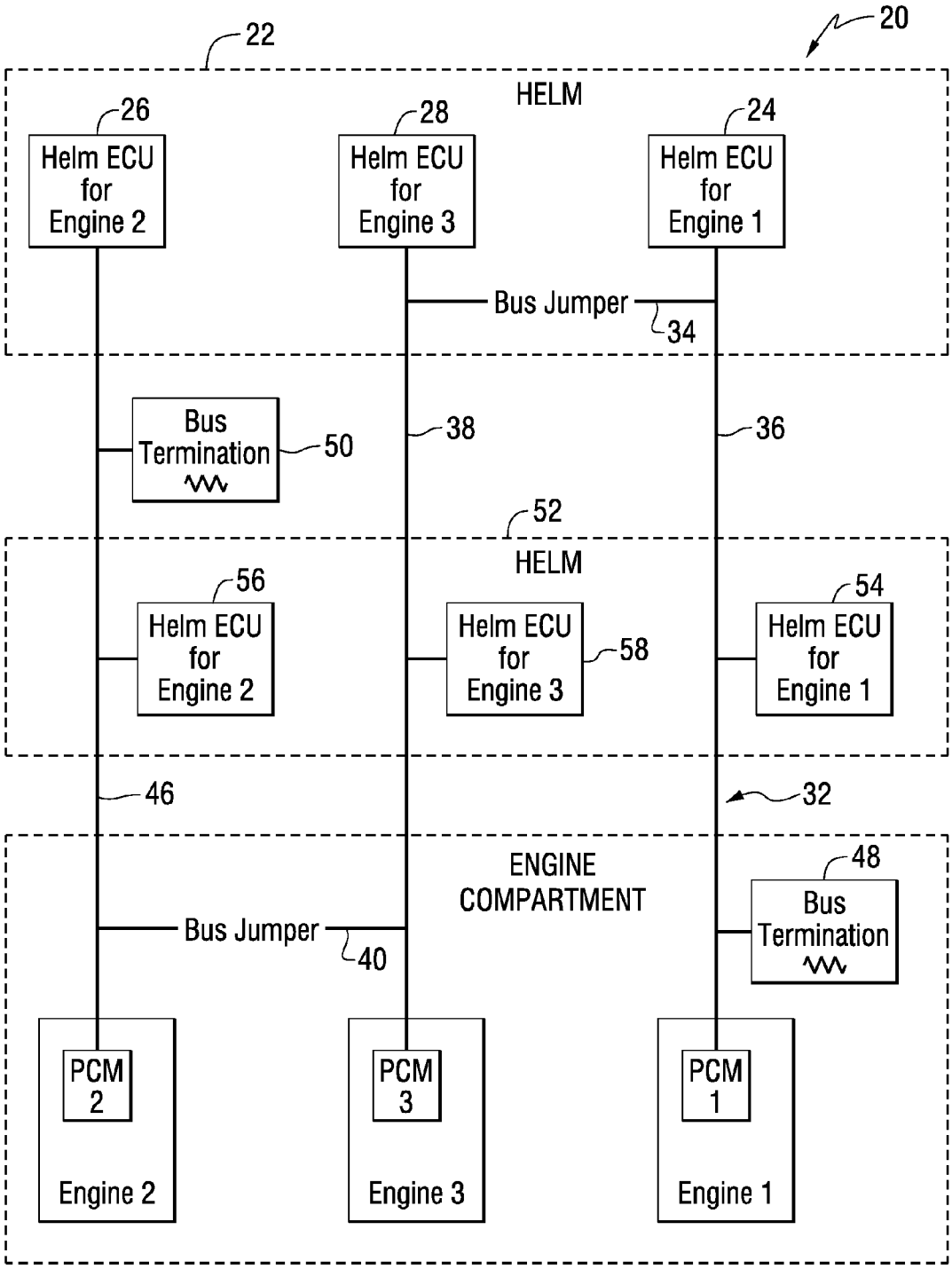
FIG. 2 PRIOR ART
FIG. 2 shows another marine propulsion drive-by-wire control system known in the prior art.

FIG. 2 uses like reference numerals from above where appropriate to facilitate understanding. FIG. 2 shows a marine propulsion drive-by-wire control system for three marine engines, namely engine 1, engine 2, engine 3.

Figure 3:
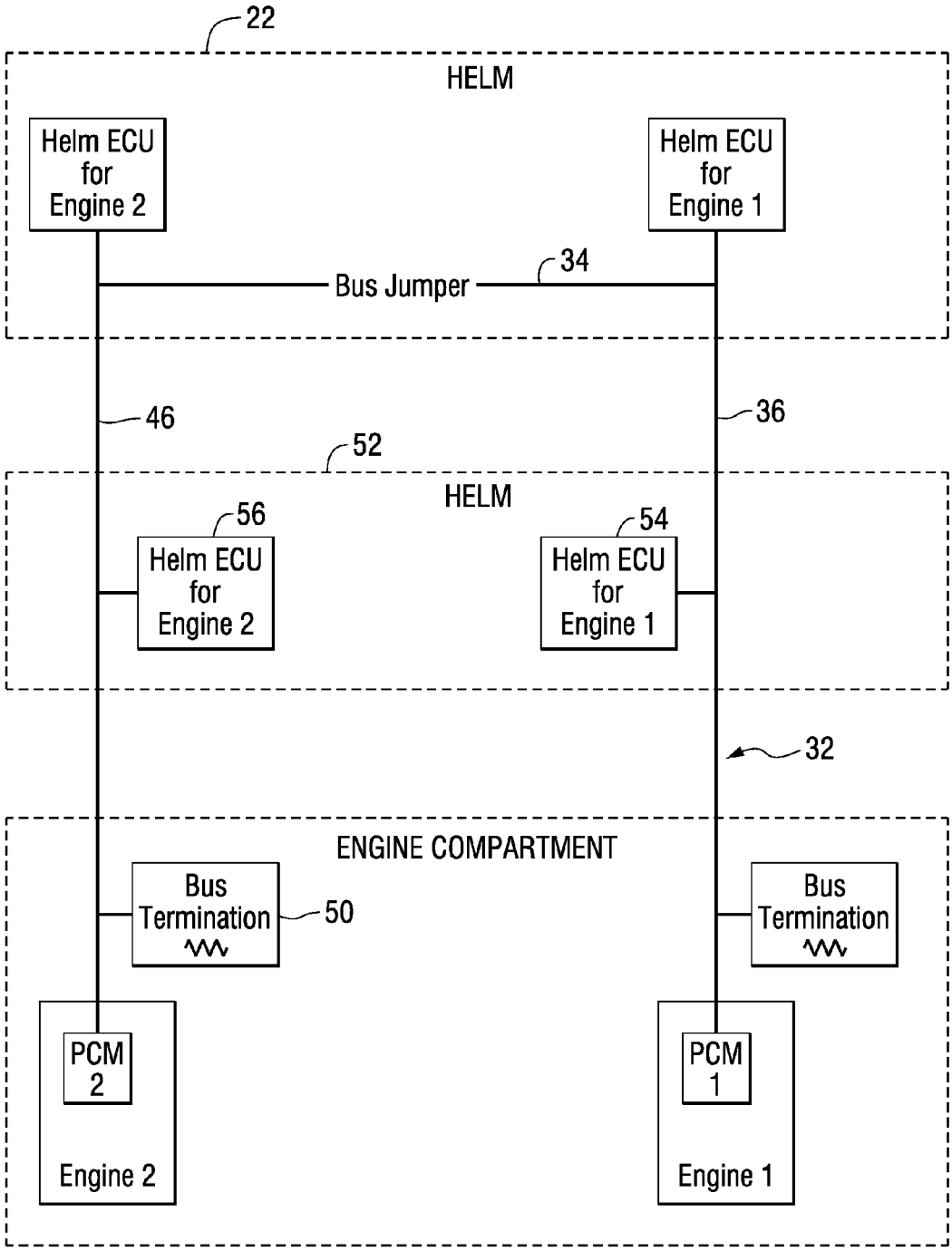
FIG. 3 PRIOR ART
FIG. 3 shows another marine propulsion drive-by-wire control system known in the prior art.

FIG. 3 uses like reference numerals from above where appropriate understanding. FIG. 3 shows a marine propulsion drive-by-wire control system for two marine engines, namely engine 1, engine 2. Other numbers of marine engines may be controlled by the noted marine propulsion drive-by-wire control systems.

Present Application

Figure 4:
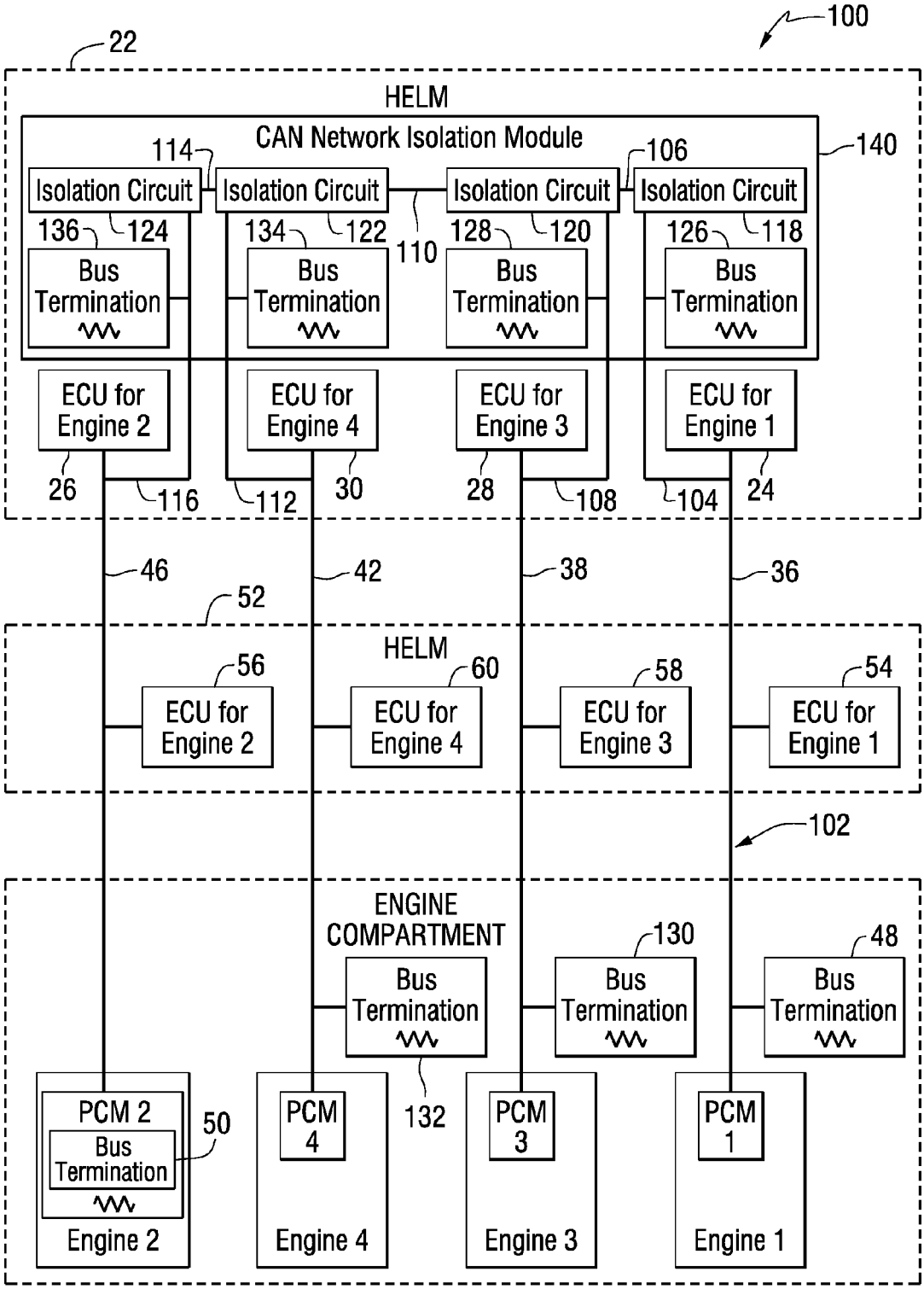
FIG. 4 shows a marine propulsion drive-by-wire control system in accordance with the invention.

FIG. 4 shows a marine propulsion drive-by-wire control system 100 in accordance with the present invention and uses like reference numerals from above where appropriate to facilitate understanding. CAN bus 102 connects the ECUs and PCMs and has multiple PCM buses 36, 38, 42, 46 as above, and has multiple ECU buses 104, 106, 108, 110, 112, 114, 116 connecting ECUs 24, 28, 30, 26 to each other and to the PCM buses. ECU bus 104 is connected to ECU bus 106 through isolation circuit 118. ECU bus 106 is connected to ECU bus 108 through isolation circuit 120. ECU bus 106 is connected to ECU bus 110 through isolation circuit 120. ECU bus 110 is connected to ECU bus 112 through isolation circuit 122. ECU bus 110 is connected to ECU bus 114 through isolation circuit 122. ECU bus 114 is connected to ECU bus 116 through isolation circuit 124. In this manner, each ECU bus is connected to another ECU bus through a respective isolation circuit isolating the respective ECU bus from spurious signals in another ECU bus, for example ingress emissions, RFI, radio frequency interference, or other interference, a short in one of the buses such as a PCM bus such as a shorted twisted conductive wire pair, and so on. Various isolation circuits may be used, such as optical, solid state, and other isolation circuits providing conductivity or ohmic isolation. A pair of bus terminations is provided for each PCM bus, for example: bus termination 48 at the junction of PCM 1 and bus 36, and bus termination 126 at the junction of PCM bus 36 and ECU 24 at ECU bus 104; bus termination 128 at the junction of PCM bus 38 and ECU 28 at ECU bus 108; bus termination 130 at the junction of PCM 3 and bus 38; bus termination 132 at the junction of PCM 4 and bus 42; bus termination 134 at the junction of PCM bus 42 and ECU 30 at ECU bus 112; bus termination 136 at the junction of PCM bus 46 and ECU 26 at ECU bus 116; bus termination 50 at the junction of PCM 2 and bus 46, which bus termination 50 may be part of PCM 2, as some PCMs include an internal bus termination, and likewise for bus termination 48 and PCM 1. The marine propulsion drive-by-wire control system may be used for multiple marine engines, including two, three, four, or more engines.

PCM buses 36, 38, 42, 46 are connected in parallel. ECU buses 106, 110, 114 are connected in series. Multiple isolation circuits are provided, namely an isolation circuit 118, 120, 122, 124, preferably for each ECU 24, 28, 30, 26, respectively. Each isolation circuit has at least two terminals including a first terminal connected to a respective ECU and a respective PCM bus, and a second terminal connected to another ECU, for example as shown at isolation circuits 118, 124. At least one or more other isolation circuits have three terminals, namely a first terminal connected to its respective ECU and its respective PCM bus, a second terminal second to another ECU, and a third terminal connected to a further different ECU, for example as shown at isolation circuits 120, 122. Each PCM bus has a pair of bus terminations, namely a first bus termination connected to its respective PCM, and a second bus termination connected to its respective ECU and its respective isolation circuit, as noted above. The terminations are provided at the farthest helm 22. Second helm 52 has multiple ECUs for controlling the multiple marine engines, the ECUs 54, 58, 60, 56 of the second helm 52 being redundant to the ECUs 24, 28, 30, 26 of the first helm 22. The ECU buses include a first set of serial ECU buses 106, 110, 114 connected by respective isolation circuits 120, 122 therebetween, and a second set of parallel ECU buses 104, 108, 112, 116 each connected between a respective isolation circuit 118, 120, 122, 124 and a respective ECU 24, 28, 30, 26.

As is known, for marine propulsion drive-by-wire control systems having multiple marine engines, a shared CAN bus must be conductively connected to each controller CAN transceiver on the bus located throughout the vessel. With CAN bus node drop lengths, bus lengths and vessel routing limitations, the routing of the bus can be problematic. As bus length is increased, propagation delay may be a concern. With a single conductive bus, induced noise, e.g. electromagnetic interference, on the CAN bus propagates to the conductively coupled modules and controllers and can affect the bit sampling for the ECUs connected to the bus. Some ECUs contain built-in terminations for terminating the CAN bus, which in turn means that such ECU will be at the farthest end of the CAN bus. However, with implementations of more than two engines, three, four, five, six, etc. engines, such configuration makes it impossible to conductively tie internally terminated ECUs together due to the fact that only two terminations can exist on the bus and must be located at the farthest ends of the shared bus. Within the marine industry, the propulsion system provider does not have installation quality control over the final vessel built, and accordingly the vessel builder must be relied upon to properly install the supplied harnessing and properly terminate the CAN bus. This can be problematic when additional helms and engines are added to the vessel, and the concordant complexity of bus termination increases.

In the prior art, each bus is conductively connected from an engine bank to a helm using a twisted pair jumper, or CAN jumper. The architecture of the system is based upon the number of engines and helms installed, which in turn determines where the jumpers and terminations are placed. This can lead to confusion during installation. Some marine engines are shipped with terminations installed on the engine, and as with jumpers, the termination has to be removed from the engine based upon the CAN architecture to be supported for the shared communication bus. Jumpers and terminations are not always installed at the proper location, which can appear as a CAN communication error on the bus, sometimes referred to as an error frame. Furthermore, as engines are added to the vessel, the shared CAN network can typically run from one-half to two-thirds the length of the vessel, and as multiple engines are added the cumulative run back and forth can exceed the recommended length of the bus.

In one embodiment of the present system, the jumpers such as 34, 40, 44, which are otherwise installed at various locations depending on vessel and engine configuration, are eliminated. In removing the conductive jumpers, the effective length of the conductive CAN bus is reduced for each propulsion bank, e.g. for each PCM. In the present preferred embodiment, a module such as CAN network isolation module 140 containing the isolation circuits, preferably including isolation repeaters, is located at the farthest helm such as 22 and contains terminations, such as 126, 128, 134, 136, for each PCM bus 36, 38, 42, 46. The PCMs preferably contain terminations for each bus, either internally as at 50, or externally as at 48, 130, 132. The noted bus terminations define the farthest ends of the bus and limit and reduce length, particularly eliminating the noted back and forth cumulatively increasing bus length. For example, the length of PCM bus 36 is simply the length between bus termination 48 at PCM 1 of engine 1 and bus termination 126 at ECU 24 at helm 22. This significantly simplifies termination strategy, and eases installation of shared communication buses. In the preferred embodiment, this architecture eliminates a bus that would normally conductively be a lengthy path to all modules in the system, for example as shown in FIG. 1. In the preferred embodiment, each of the noted buses is isolated from each other, to provide the noted advantages. A direct short on one bus will not short the remaining isolated buses. EMI induced or ingress noise on one bus will not conductively propagate to other buses of the CAN bus network. Each bus is terminated respectively at each end of the bus for each engine, thus simplifying the termination layout for multiple engine applications, which is particularly desirable for installation.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. A marine propulsion drive-by-wire control system for multiple marine engines each having a PCM, propulsion control module, a helm having multiple ECUs, electronic control units, for controlling said multiple marine engines, a CAN, control area network, bus connecting said ECUs and PCMs, said CAN bus having multiple PCM buses each connecting a respective PCM to a respective ECU, said CAN bus having multiple ECU buses connecting said ECUs to each other, each said ECU bus being connected to another said ECU bus through a respective isolation circuit isolating the respective ECU bus from spurious signals in another ECU bus.

2. The marine propulsion drive-by-wire control system according to claim 1 wherein said PCM buses are connected in parallel, and said ECU buses are connected in series.

3. The marine propulsion drive-by-wire control system according to claim 1 comprising multiple said isolation circuits, namely an isolation circuit for each said ECU.

4. The marine propulsion drive-by-wire control system according to claim 3 wherein each said isolation circuit has at least two terminals including a first terminal connected to a respective said ECU and a respective said PCM bus, and a second terminal connected to another ECU.

5. The marine propulsion drive-by-wire control system according to claim 4 wherein at least one of said isolation circuits has three terminals, namely first terminal connected to its respective ECU and its respective said PCM bus, said second terminal connected to another ECU, and a third terminal connected to a further ECU different than said other ECU.

6. The marine propulsion drive-by-wire control system according to claim 3 wherein each said PCM bus has a pair of bus terminations, namely a first bus termination connected to its respective said PCM, and a second bus termination connected to its respective said ECU and its respective said isolation circuit.

7. The marine propulsion drive-by-wire control system according to claim 1 wherein said helm is a first helm, and comprising a second helm having multiple ECUs for controlling said marine engines, said ECUs of said second helm being redundant to said ECUs of said first helm.

8. The marine propulsion drive-by-wire control system according to claim 1 comprising two said marine engines each having a PCM, namely a first marine engine having a first PCM, and a second marine engine having a second PCM, said helm comprising two ECUs, namely a first ECU for controlling said first marine engine, and a second ECU for controlling said second marine engine, said CAN bus having two PCM buses, namely a first PCM bus connecting said first PCM to said first ECU, and a second PCM bus connecting said second PCM to said second ECU, said CAN bus comprising two said ECU buses, namely a first ECU bus connecting said first ECU to said isolation circuit, and a second ECU bus connecting said second ECU to said isolation circuit.

9. The marine propulsion drive-by-wire control system according to claim 8 comprising a third said marine engine having a third PCM, said helm comprising a third ECU for controlling said third marine engine, said CAN bus having a third PCM bus connecting said third PCM to said third ECU, said CAN bus having a third ECU bus connecting said third ECU to said isolation circuit.

10. The marine propulsion drive-by-wire control system according to claim 9 comprising a fourth said marine engine having a fourth PCM, said helm comprising a fourth ECU for controlling said fourth marine engine, said CAN bus having a fourth PCM bus connecting said fourth PCM to said fourth ECU, said CAN bus having a fourth ECU bus connecting said fourth ECU to said isolation circuit.

11. The marine propulsion drive-by-wire control system according to claim 1 comprising multiple said isolation circuits, one for each said ECU, and wherein said ECU buses comprise a first set of serial ECU buses connected by respective isolation circuits therebetween, and a second set of parallel ECU buses each connected between a respective said isolation circuit and a respective ECU.

12. The marine propulsion drive-by-wire control system according to claim 11 wherein at least one of said isolation circuits has a pair of terminals, one of which is connected to its respective said ECU, and the other of which is connected to another isolation circuit, and wherein said other isolation circuit has three terminals, the first of which is connected to said one isolation circuit, the second of which is connected to its respective said ECU, and the third of which is connected to a yet further isolation circuit different than said one isolation circuit.

13. The marine propulsion drive-by-wire control system according to claim 12 comprising two said marine engines each having a PCM, namely a first marine engine having a first PCM, and a second marine engine having a second PCM, said helm comprising two ECUs, namely a first ECU for controlling said first marine engine, and a second ECU for controlling said second marine engine, said CAN bus having two PCM buses, namely a first PCM bus connecting said first PCM to said first ECU, and a second PCM bus connecting said second PCM to said second ECU, said CAN bus comprising two said ECU buses, namely a first ECU bus connecting said first ECU to said isolation circuit, and a second ECU bus connecting said second ECU to said isolation circuit, a first bus termination at the junction of said first PCM and said first PCM bus, a second bus termination at the junction of said first ECU and said first PCM bus, a third bus termination at the junction of said second PCM and said second PCM bus, a fourth bus termination at the junction of said second ECU and said second PCM bus.

14. The marine propulsion drive-by-wire control system according to claim 1 comprising two said marine engines each having a PCM, namely a first marine engine having a first PCM, and a second marine engine having a second PCM, said helm comprising two ECUs, namely a first ECU for controlling said first marine engine, and a second ECU for controlling said second marine engine, said CAN bus having two PCM buses, namely a first PCM bus connecting said first PCM to said first ECU, and a second PCM bus connecting said second PCM to said second ECU, said CAN bus comprising two said ECU buses, namely a first ECU bus connecting said first ECU to said isolation circuit, and a second ECU bus connecting said second ECU to said isolation circuit, wherein said helm is a first helm, and comprising a second helm having at least two ECUs for controlling said marine engines, namely a third ECU for controlling said first marine engine, and a fourth ECU for controlling said second marine engine, said third ECU being connected to said first PCM bus between said first PCM and said first ECU, said fourth ECU being connected to said second PCM bus between said second PCM and second ECU, said isolation circuit being connected to said first PCM bus between said first ECU and said third ECU, said isolation circuit being connected to said second PCM bus between said second ECU and said fourth ECU.

15. The marine propulsion drive-by-wire control system according to claim 1 wherein said isolation circuit comprises an optical isolation circuit.

16. The marine propulsion drive-by-wire control system according to claim 1 wherein said isolation circuit comprises a solid state isolation circuit.

17. A marine propulsion drive-by-wire control system for multiple marine engines each having a PCM, propulsion control module, a helm having multiple ECUs, electronic control units, for controlling said multiple marine engines, a CAN, control area network, bus connecting said ECUs and PCMs, said CAN bus having multiple PCM buses each connecting a respective PCM to a respective ECU, said CAN bus having multiple ECU buses connecting said ECUs to each other, each said ECU bus being connected to another said ECU bus through a respective isolation circuit isolating the respective ECU bus from spurious signals in another ECU bus, and comprising multiple said isolation circuits, wherein each said PCM bus has a pair of bus terminations, namely a first bus termination connected to its respective said PCM, and a second bus termination connected to its respective said ECU and its respective said isolation circuit, and comprising a CAN network isolation module at said helm containing said isolation circuits and said second bus terminations.

18. A method for controlling a marine propulsion drive-by-wire control system for multiple marine engines, comprising providing each engine with a PCM, propulsion control module, providing a helm having multiple ECUs, electronic control units, for controlling said multiple marine engines, providing a CAN, controller area network, bus connecting said ECUs and PCMs, providing said CAN bus with multiple PCM buses each connecting a respective PCM to a respective ECU, providing said CAN bus with multiple ECU buses connecting said ECUs to each other, and connecting each said ECU bus to another said ECU bus through a respective isolation circuit isolating the respective ECU bus from spurious signals in another ECU bus.

19. The method according to claim 18 comprising connecting said PCM buses in parallel, providing said ECU buses with a first set of ECU buses and connecting said first set of ECU buses in series, providing a second set of ECU buses and connecting said second set of ECU buses in parallel.

20. The method according to claim 19 comprising providing a plurality of said isolation circuits, one for each said ECU, connecting each said ECU to a respective PCM bus and a respective ECU bus of said first set, and connecting said isolation circuits to each other with said second set of ECU buses in series.

21. The method according to claim 18 comprising terminating each of said PCM buses at respective pairs of first and second bus terminations, namely terminating each said PCM bus at a first bus termination at its respective said PCM, and terminating each said PCM bus at a second bus termination at its respective said ECU.

* * * * *